US007050745B2

(12) United States Patent
Kikuchi

(10) Patent No.: US 7,050,745 B2
(45) Date of Patent: May 23, 2006

(54) TWO-COMPONENT DEVELOPER UNIT OF ELECTROPHOTOGRAPHIC IMAGE FORMING APPARATUS HAVING LIFTING GUIDE PORTION

(75) Inventor: Susumu Kikuchi, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 29 days.

(21) Appl. No.: 10/256,236

(22) Filed: Sep. 27, 2002

(65) Prior Publication Data

US 2003/0086728 A1 May 8, 2003

(30) Foreign Application Priority Data

Sep. 27, 2001 (JP) ..... 2001-298056

(51) Int. Cl.
*G03G 15/08* (2006.01)

(52) U.S. Cl. ..... 399/272

(58) Field of Classification Search ..... 399/274, 399/275, 284, 272, 267, 279, 281
See application file for complete search history.

(56) References Cited

U.S. PATENT DOCUMENTS

| | | | | |
|---|---|---|---|---|
| 4,438,722 | A * | 3/1984 | Forlani | 399/272 |
| 4,453,493 | A * | 6/1984 | Sawayama et al. | 399/254 |
| 4,676,192 | A * | 6/1987 | Yuge et al. | 399/259 |
| 4,851,872 | A * | 7/1989 | Murasaki et al. | 399/275 |
| 5,003,917 | A * | 4/1991 | Toyoshi et al. | 399/258 |
| 5,758,241 | A * | 5/1998 | Oyama et al. | 399/272 |
| 5,771,426 | A * | 6/1998 | Oka et al. | 399/119 |
| 6,522,855 | B1 * | 2/2003 | Katoh et al. | 399/274 |

* cited by examiner

*Primary Examiner*—Robert Beatty
(74) *Attorney, Agent, or Firm*—Staas & Halsey LLP

(57) ABSTRACT

A two-component developer unit of an electrophotographic image forming apparatus includes a developer rectifier having a lifting guide portion and a developer collection guide portion. The lifting guide portion guides a developer agitated by an agitating unit upward along a circumferential direction of a developer magnet roller. The developer collection guide portion keeps the developer to move down to the lifting guide portion between a developer blade and the lifting guide portion. A non-uniformity of image intensity can be solved without giving an overweight load to the developer and a photoreceptor and without increasing a driving torque of the developer and the photoreceptor.

34 Claims, 6 Drawing Sheets

TWO-COMPONENT DEVELOPER UNIT OF ELECTROPHOTOGRAPHIC IMAGE FORMING APPARATUS HAVING LIFTING GUIDE PORTION

CROSS-REFERENCE TO RELATED APPLICATIONS

This application claims the benefit of Japanese Patent Application No. 2001-298056, filed Sep. 27, 2001, in the Japanese Patent office, the disclosure of which is incorporated herein in by reference.

BACKGROUND OF THE INVENTION

1. Field of the Invention

The present invention relates to a two-component developer unit of a dry electrophotographic image forming apparatus, and more particularly, to a two-component developer unit of a dry electrophotographic image forming apparatus having a rectifier capable of solving nonuniformity of a developing density caused by a lack of a developer.

2. Description of the Related Art

Recently, a dry electrophotographic image forming apparatus, e.g., a laser printer, a facsimile using ordinary papers, a digital copier, etc., is in widespread use.

A two-component developing method is used in a dry electrophotographic image forming apparatus. In the two-component developing method, a developer is formed by agitating a mixture of nonmagnetic toner and a magnetic powder carrier and then producing frictional static electricity among toner particles so that the toner particles are adsorbed to the magnetic powder carrier. Next, the developer is adsorbed onto a developer magnet roller having a developer sleeve and rotated on a fixed magnetic pole, and then transferred to a photoreceptor. Next, a magnetic brush formed on the photoreceptor develops a latent electrostatic image on the photoreceptor.

FIG. 1 is a schematic cross-sectional view of a conventional two-component developer unit used in a laser printer. Referring to FIG. 1, in the laser printer, a printed surface of a printing paper 17 faces downward via a C-type transfer path through which the printing paper 17 is fed upward from a paper cassette (not shown) disposed under the laser printer. Thus, a laser beam 5 that is modulated to an image signal is horizontally incident on an exposure point of a photoreceptor 1, which has been charged with a predetermined potential by an erasing roller 24. Thus, the photoreceptor 1 is exposed to the laser beam, and then a latent electrostatic image is recorded on the photoreceptor 1. The conventional two-component developer unit includes a blade installing portion 8*b*, a toner density sensor 12, another gear 19 of the separator 20, a lamp guide 22 of the erase lamp 25, and another gear 25 rotating the erasing roller 24.

The photoreceptor 1 rotates clockwise as shown with an arrow so that the latent electrostatic image is developed by a developer unit A at a developing point having an angle of 70° with the exposure point with respect to a center of the photoreceptor 1. As a result, a toner image is formed on the photoreceptor 1, and the photoreceptor 1 faces the printing paper 17, which is fed to a transfer point having an angle of 100° with the developing point with respect to the center of the photoreceptor 1 and is supplied with a transfer voltage from a transfer roller 18 so as to transfer the toner image onto the printing paper 17.

The printing paper 17 is obliquely fed to the laser printer, fixed by a fixing unit (not shown), and discharged upward.

Accordingly, the erasing roller 24, an erasing lamp 23, a cleaning blade 21, and a separator 20 shown in FIG. 1 are disposed over the laser beam 5. Also, the developer unit A, which can be put into and pull out of a housing 2 like a cartridge, is disposed under the laser beam 5.

The developer unit A includes a toner feeding unit 3 having a toner feeding roller 4 and a toner agitating roller 6. Toner drops from a toner feeding outlet 3*a* underneath the toner feeding roller 4, is mixed with a developer 16 containing a carrier and the toner circulating in an inside of the housing 2, agitated, and charged with another predetermined potential. Here, a developer transfer roller 10 and an agitating paddle 11 mix and agitate the carrier and the toner and the developer 16.

FIG. 2 is a left side view and a front view of the developer transfer roller 10 used in a prior art two-component developer unit and a present invention developer unit. Referring to FIG. 2, the developer transfer roller 10 has a drive shaft 10*c* at its both ends, which rotates the developer transfer roller 10, and a plurality of transfer paddles 10*a* which are formed by cutting end portions of circular plates. The transfer paddles 10*a* slant with respect to the drive shaft 10*c* and disposed to be spaced apart from each other around a roller shaft 10*b*, which connects the transfer paddles 10*a*.

Accordingly, if the developer transfer roller 10 rotates one time, the transfer paddles 10*a* operate as wings so as to agitate and transfer the developer 16 in an axial direction and a circumferential direction of the developer transfer roller 10. Thus, the developer 16 transferred in the circumferential direction of the developer transfer roller 10 creates a two-time peak whenever the developer transfer roller 10 rotates one time.

In the above-described structure, the amount of the developer 16 adsorbed onto a developer magnet roller 7 is pulsated in a circumferential direction of the developer magnet roller 7. When the developer 16 having a non-uniform thickness reaches the developing point, a supply of the toner is excessive or short depending on the non-uniform thickness of the developer 16 on the developer magnet roller 7. Thus, an amount of the toner attached to the latent electrostatic image varies and an image is shaded in a horizontal direction. As a result, the image becomes non-uniform, and thus a quality of the image deteriorates.

Therefore, a developer blade 8 having a flat shape is installed between the developer transfer roller 10 and the photoreceptor 1. A blade tip 8*a* is spaced apart from the developer magnet roller 7 so as to control the thickness of the developer 16 to a predetermined height. The blade tip 8*a* removes pulsated portions of the developer 16 from the developer magnet roller 7.

However, according to the above-described structure, since the developer magnet roller 7 is placed over the developer transfer roller 10, the developer magnet roller 7 serves to draw up the transferred developer 16. In this structure, a portion for collecting the sufficient amount of the developer 16 may not be formed around the developer blade 8. Thus, the intensity of the image becomes non-uniform and the image quality deteriorates.

Accordingly, to solve the above problems, a distance between the developer magnet roller 7 and the developer blade 8 is increased even though the portion collecting the developer is not included around the developer blade 8, a region, which is called an "ear-type collection portion", is formed adjacent to the developing point so as to gather the sufficient amount of the developer 16 between the photoreceptor 1 and the developer magnet roller 7.

However, in the above-described structure, since the developer 16 gathered in the ear-type collection portion violently contacts the photoreceptor 1, an overweight load is given to the developer 16 and the photoreceptor 1, the toner adheres to the carrier, and the surface of the photoreceptor 1 is worn out. As a result, a life span of the developer 16 and the photoreceptor 1 is shortened. Also, since a torque of a drive motor rotating the photoreceptor 1 is increased, the drive motor has to be large-sized.

SUMMARY OF THE INVENTION

To solve the above and other problems, it is an object of the present invention to provide a two-component developer unit which is capable of reducing a uniformity of an intensity (thickness) of a developer due to an insufficient supply of the developer without applying an overweight load to the developer or a photoreceptor when drawing up and transferring the developer to the photoreceptor and without increasing a torque of a drive motor rotating the developer or the photoreceptor.

Additional objects and advantageous of the invention will be set forth in part in the description which follows and, in part, will be obvious from the description, or may be learned by practice of the invention.

Accordingly, to achieve the above and other objects, there is provided a two-component developer unit. The developer unit includes an agitating unit, a developer magnet roller, a developer blade, and a developer rectifier. The agitating unit agitates a developer including a carrier and powder toner. The developer magnet roller has a magnet roller that is disposed adjacent to the agitating unit, given a predetermined magnetic flux density, and fixed on a housing. The developer magnet roller also includes a developer sleeve rotating a circumferential surface of the magnet roller and adsorbs the developer thereon by using a magnetic force, and returns the developer downward. The developer blade faces the developer magnet roller, disposed to be spaced-apart from the developer magnet roller by a predetermined control distance, and controls a thickness of the developer adhering onto the developer magnet roller.

The developer rectifier guides the developer transferred by the developer magnet roller up to the developer blade. The developer rectifier includes a lifting guide portion that guides the developer agitated by the agitating unit so as to transfer the developer upward along a circumferential direction of the developer magnet roller and a developer collection guide portion that retains the developer collected down the lifting guide portion and between the developer blade and the developer collection guide portion. Here, the developer rectifier is disposed between the agitating unit and the developer blade at the control distance from the developer magnet roller along an effective development width.

BRIEF DESCRIPTION OF THE DRAWINGS

The above object and advantages of the present invention will become more apparent and more readily appreciated from the following description of the preferred embodiments, taken in conjunction with the accompanying drawings of which.

DETAILED DESCRIPTION OF THE PREFERRED EMBODIMENTS

Figure 1:
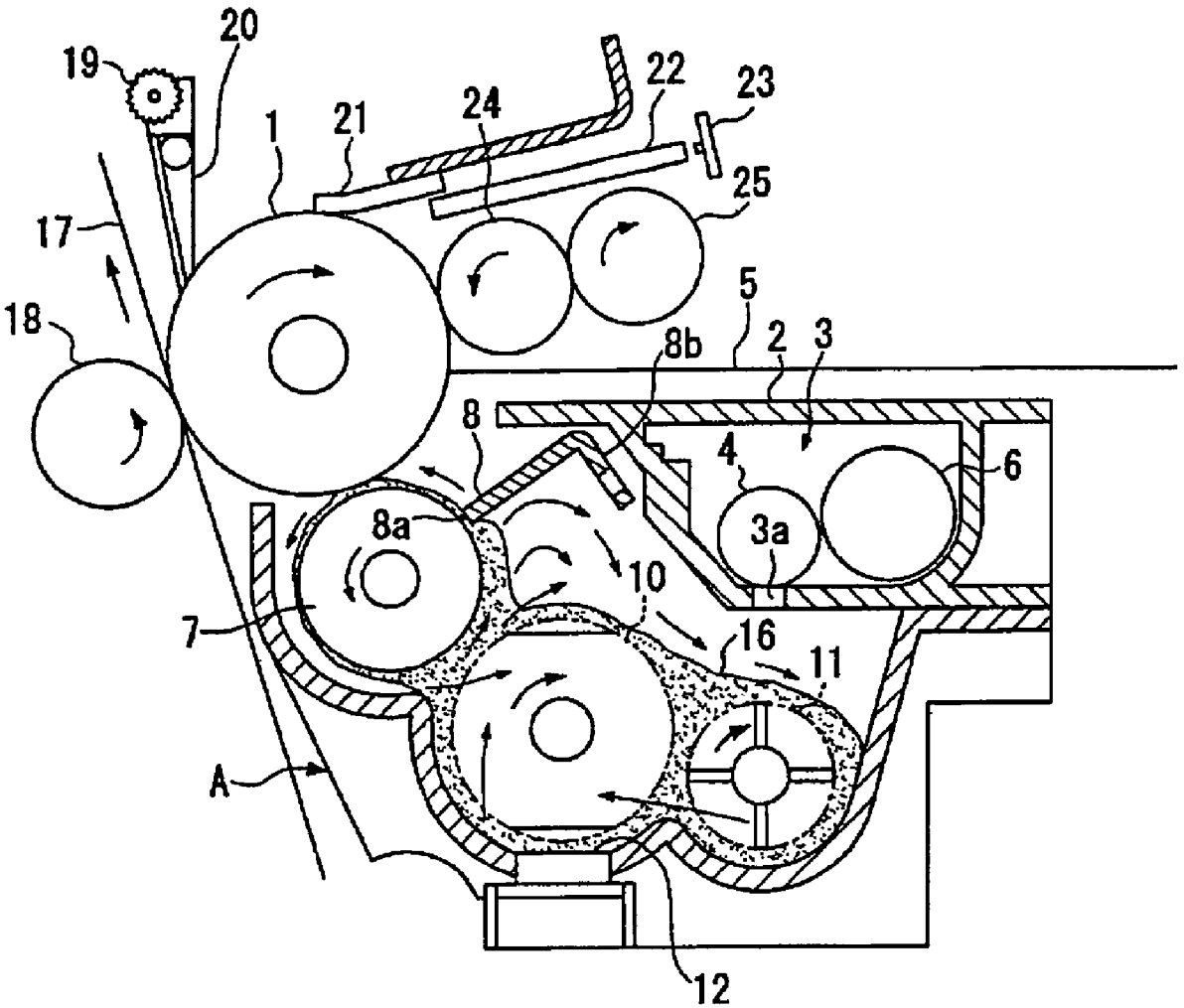
FIG. 1 (PRIOR ART)
FIG. 1 is a partial cross-sectional view of a conventional two-component developer unit.
Figure 2:
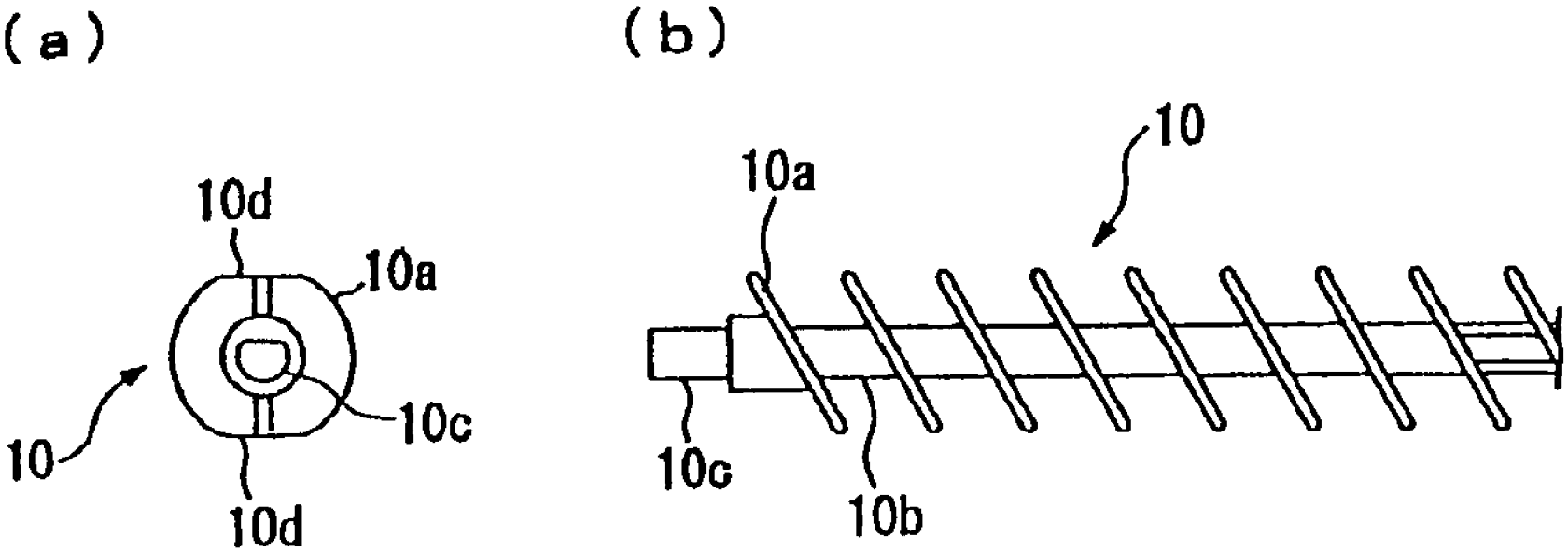
FIG. 2 (PRIOR ART)
FIG. 2 is a left side view and a front view of a developer transfer roller used in a prior art two-component developer unit and a present invention developer unit.

Reference will now be made in detail to the present preferred embodiment of the present invention, examples of which are illustrated in the accompanying drawings, wherein like reference numerals refer to the like elements throughout. The embodiment is described in order to explain the present invention by referring to the figures.

Figure 3:
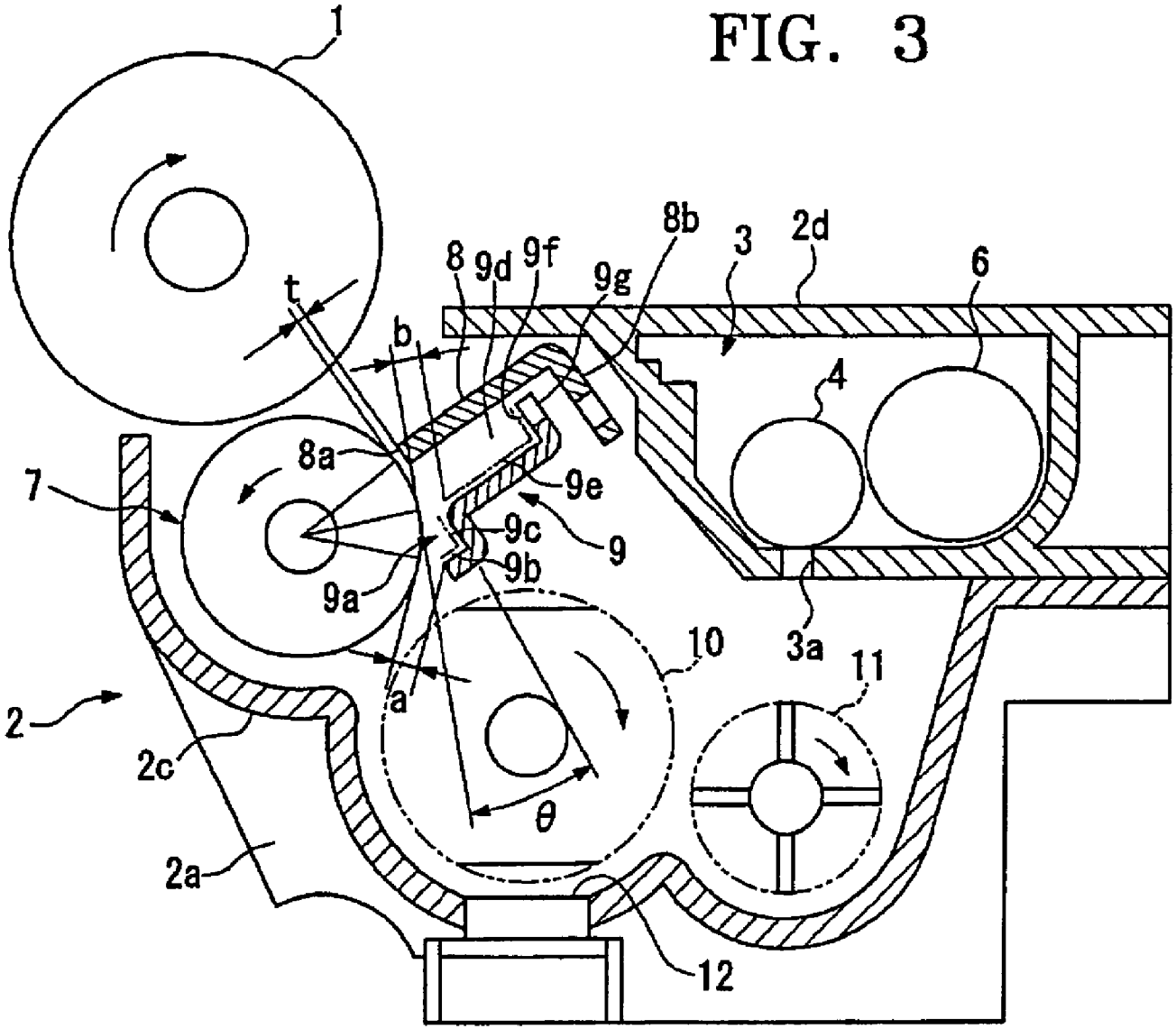
FIG. 3 is a partial cross-sectional view of a two-component developer unit according to an embodiment of the present invention.

FIG. 3 is a partial cross-sectional view of a two-component developer unit according to an embodiment of the present invention. The developer unit uses a two-component developing method employing a dry electrophotograph. The developer unit is mounted in an image forming apparatus, such as a laser printer, a facsimile using general printing papers, a digital copier, etc., using a dry electrophotograph to perform a developing process. For example, the developer unit is mounted in a housing 2, which may have the same shape as the developer unit A of FIG. 1, built in the laser printer so as to perform the developing process. Elements of the developer unit shown in FIG. 3 are the same as the elements of the developer unit shown in FIG. 1 except a developer rectifier 9. Thus, hereinafter, descriptions of the same structure of the laser printer, which was previously described with reference to FIG. 1 and is mounted in the developer unit of the present invention, will be omitted. In FIG. 3, only a photoreceptor 1 is illustrated to show a relationship between the laser printer and the developer unit of the present invention. In the drawings, same or corresponding elements denote the same reference numerals.

Referring to FIG. 3, the two-component developer unit is formed by molding synthetic resins, such as a styrene resin, an ABS resin, or the like. The two-component develop unit includes a substructure 2*c*, a toner feeing unit 3, an upperstructure 2*d*, and a housing 2 so as to form a single unit integrally and be attachable to and detachable from the laser printer. The substructure 2*c* has an opening upward, a dented portion downward, a back plate 2*a*, and a front plate (not shown). The toner feeding unit 3 contains powder toner which is made by mixing synthetic resins, such as polyester or styrene acryl with a base, melting a charge controlling material, wax, etc., in the mixture, agitating and pulverizing the melted material, and adding $SiO_2$ to the agitated material. The upperstructure 2*d* is also formed by molding the same synthetic resins as the substructure 2*c*. The housing 2, which is disposed opposite to the toner feeding unit 3, has an opening facing the photoreceptor 1.

In order that the two-component developer unit performs a developing operation, a driving force of parts of the laser printer is supplied from a rotation source through a gear (not shown), and an electrical signal, a power supply, and a voltage are supplied from signed and power sources through a connector (not shown) which is exposed from a back plate 2*a* to an outside of the housing 2. This structure is well known, and thus its descriptions will be omitted.

The toner feeding unit 3 includes a toner agitating roller 6 and a toner feeding roller 4. The toner agitating roller 6 is controlled to evenly distribute toner in the toner feeding unit 3. The toner feeding roller 4, which induces the toner in the toner feeding unit 3 to a toner feeding outlet 3*a* so as to transfer the toner into an inside of the substructure 2*c*, is disposed between the back plate 2*a* and a front plate (not shown) of the housing 2 to rotate with respect to the substructure 2*c*.

In the inside of the substructure 2*c*, an agitating paddle 11, a developer transfer roller 10, the photoreceptor 1, and a developer magnet roller 7 are disposed between the back plate 2*a* and the front plate of the housing 2 to rotate with respect to the substructure 2*c*. The agitating paddle 11 is disposed under the toner feeding roller 4. The developer transfer roller 10 is disposed adjacent to the agitating paddle 11. The photoreceptor 1 is obliquely disposed over the developer transfer roller 10. The developer magnet roller 7 forms a developing point with the photoreceptor 1.

A toner intensity sensor 12, which is a magnetic permeability sensor sensing a change of the developer 16 in magnetic permeability from the outside of the substructure 2*c*, is disposed under the developer transfer roller 10.

The agitating paddle 11 includes four agitating plates 11*a*, which axially extend, in order to agitate the toner supplied through the toner feeding outlet 3*a* and another developer (not shown in FIG. 3) contained in the inside of the substructure 2*c*, to charge toner with a predetermined potential, and to adsorb the toner to the developer.

Figure 4:
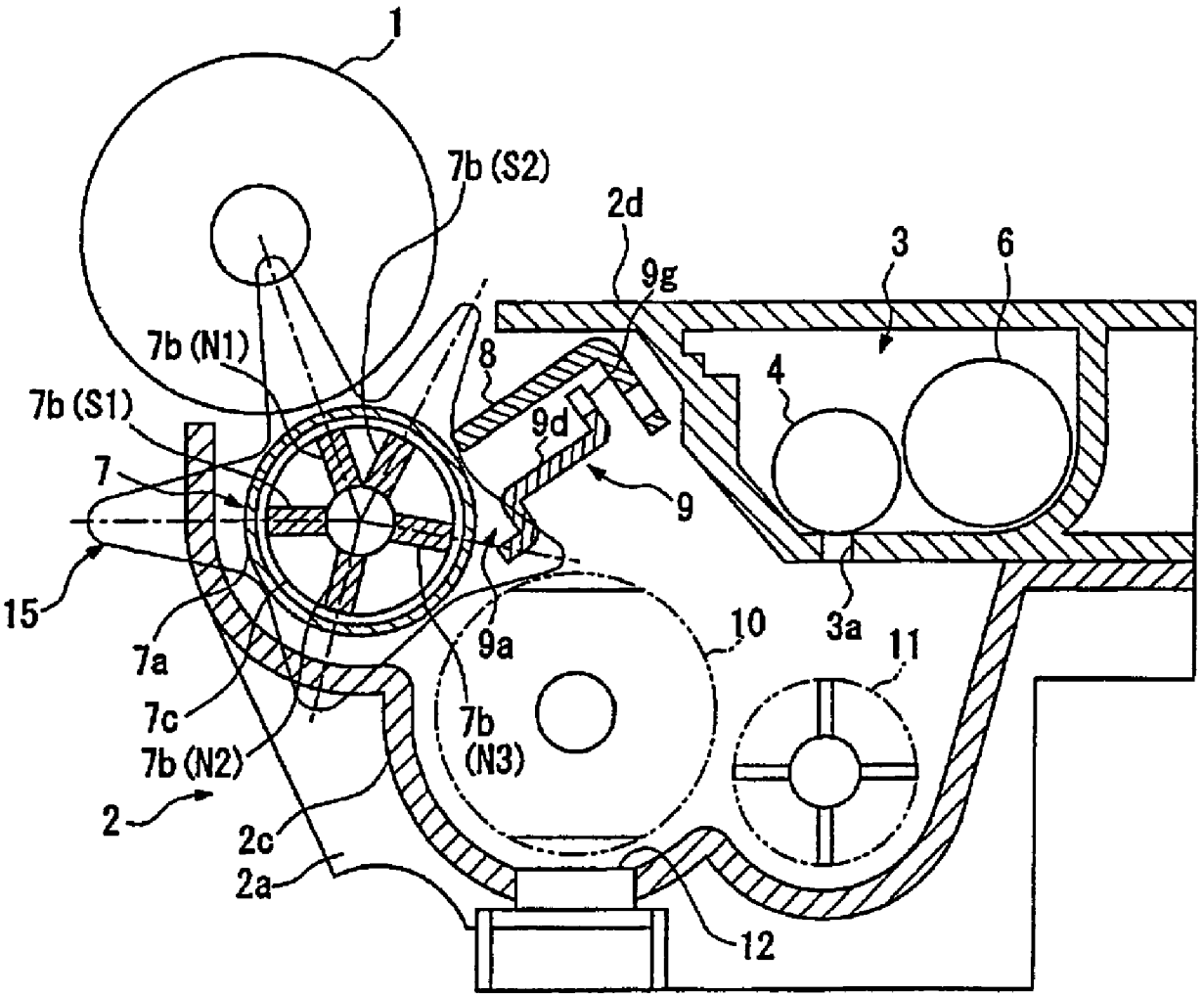
FIG. 4 is a cross-sectional view explaining a magnetic flux density of a developer magnet roller of the two-component developer unit shown in FIG. 3.

The developer magnet roller 7, as shown in FIG. 4, includes a magnet roller 7*c* which is supported by a fixed shaft and has predetermined magnetic flux density in its circumferential direction, and a developer sleeve 7*a* which is formed of an aluminium alloy or a nonmagnetic stainless, contacts the magnet roller 7*c* to rotate, and has a circular rough surface. Also, the surface of the developer sleeve 7*a* always contacts a high-pressure electrode (not shown) and is supplied with a developer bias voltage.

FIG. 4 is a cross-sectional view explaining a magnetic flux density of the developer magnet roller 7 shown in FIG. 3. Referring to FIG. 4, the magnet roller 7*c* includes five magnets 7*b* having different magnetized amounts and different polarities N1, S1, N2, N3, and S2, which are disposed under the magnet roller 7*c*. A schematic pattern of the magnetic flux density of the magnet roller 7*c* over the developer sleeve 7*a* is represented by a magnetic flux density curve 15. Examples of peak values and orientations of the magnetic flux density of the polarities are as follows. Here, azimuth angles are measured counterclockwise by setting the developing point between the developer magnet roller 1 and the photoreceptor 1 to 0 degree. Also, the polarity is expressed as N and S, and the magnetic flux density is expressed as mT.

N1: 85 mT, −3°
S1: 85 mT, 70°
N2: 40 mT, 150°
N3: 40 mT, 240°
S2: 73 mT, 320°

The magnet roller 7*c* may be a roller, which is formed of ferrite or a plastic magnet, and a surface of the magnet roller 7*c* is magnetized when the magnet roller 7*c* obtains a predetermined magnetic flux density distribution.

A developer blade 8, which is formed of a L-shaped nonmagnetic stainless plate, obliquely extends over the developer magnet roller 7. The developer blade 8 is bent so as to have a blade tip 8*a* which is an acute end of the developer blade 8 in a diametrical direction of the developer magnet roller 7. The developer blade 8 is installed in the housing 2 by a blade installing portion 8*b* which is another end of the developer blade 8. A control distance between the blade tip 8*a* and the surface of the developer magnet roller 7 is set to be a predetermined distance t (referring to FIG. 3) (control distance).

An angle of the developer blade 8 to a surface of the developer point of the photoreceptor 1 is set to be 90° based on a straight line tangent to the blade tip 8*a*. However, although the developer blade 8 is inclined from an angle of 90°, since the control distance t between the blade tip 8*a* and the developer magnet roller 7 can be formed, the angle of the developer blade 8 to the surface of the photoreceptor 1 is not necessarily 90°.

In this embodiment, since the developer magnet roller 7 is disposed under the photoreceptor 1, the developer blade 8 horizontally curves at an angle of 35°, which varies depending on a positional relationship between the photoreceptor 1 and the developer magnet roller 7, but may be within a range of 0–60° in the laser printer employing a C-type transfer path.

A developer rectifier 9 is installed between the developer transfer roller 10 and the developer blade 8 so as to form a developer collection guide portion with the developer blade 8.

Figure 5:
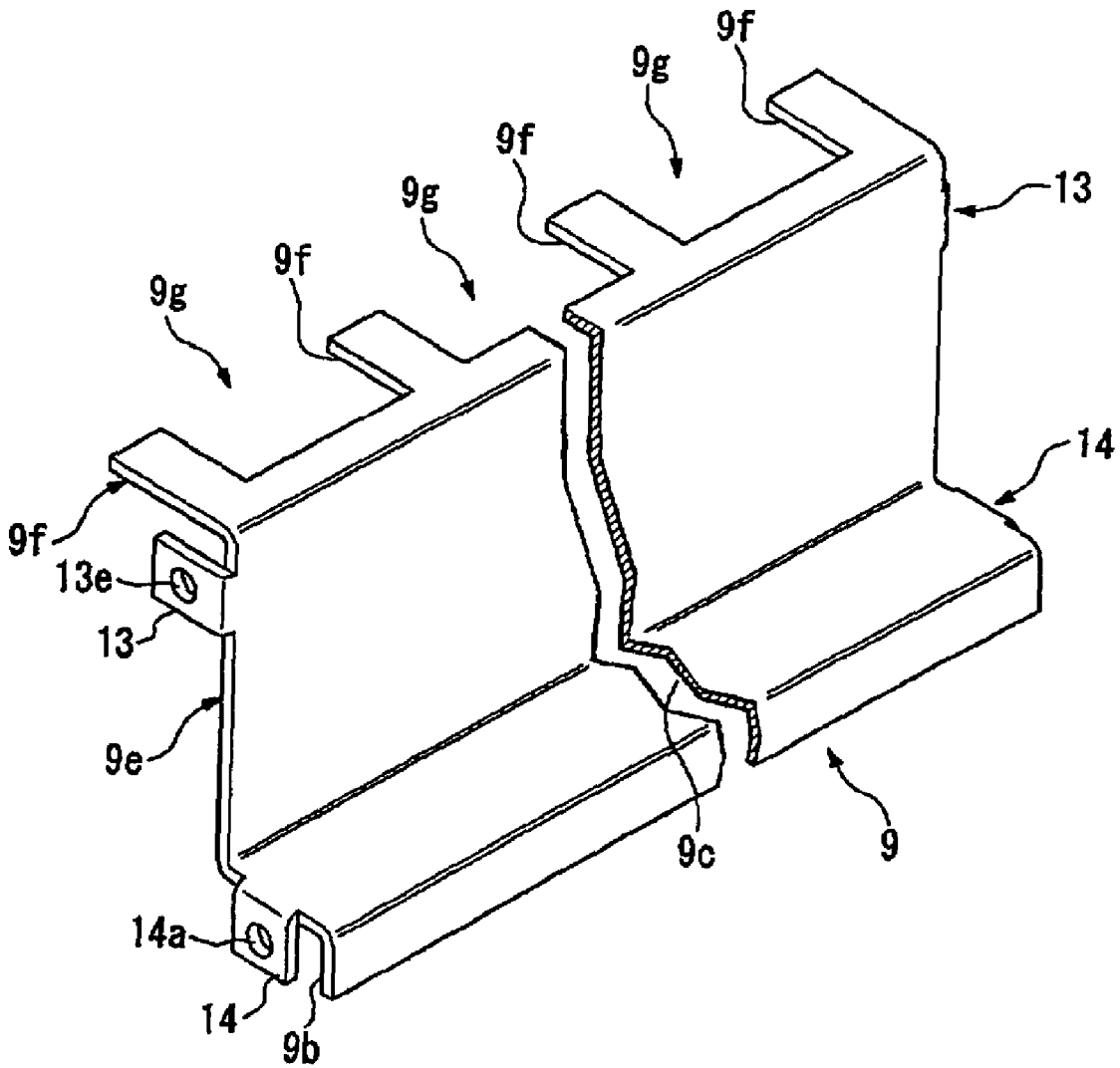
FIG. 5 is a perspective view of a developer rectifier of the two-component developer unit shown in FIGS. 3 and 4.

FIG. 5 is a perspective view of the developer rectifier 9 shown in FIGS. 3 and 4. Referring to FIGS. 4 and 5, the developer rectifier 9 is a nonmagnetic plate made of brass, stainless steel, or an aluminum alloy. The developer rectifier 9 has three V-shaped curves and a W-shaped surface. The developer rectifier 9 extends in an axial direction of the developer magnet roller 7.

Members inside the W-shaped surface denote 9*b*, 9*c*, 9*e*, and 9*f*, and positions of the members will be described in more detail blow.

The curved portion 9*b* and the guide portion 9*c* are opposite to the developer magnet roller 7 and constitute a lifting guide portion 9*a*. In particular, an end of the guide portion 9*c* extending to a standing portion 9*e* is extended from an end of the guide portion 9*c* opposite to the curved portion 9*b* and inclined at an angle θ of 45° or less with the surface of the developer magnet roller 7.

The standing portion 9*e* is parallel to the developer blade 8, and a circumferential portion 9*f* extends from the standing portion 9*e* toward the developer blade 8 so as to face the surface of the developer magnet roller 7. The circumferential portion 9*f* and the standing portion 9*e* constitute the developer collection guide portion 9*d* which is enclosed by surfaces of the developer magnet roller 7 and the developer blade 8. The circumferential portion 9*f* has an opening 9*g* as shown in FIG. 5.

Fixing portions 13 and 14 having screw holes 13*a* and 14*a* respectively extend from the guide portion 9*c* and the standing portion 9*e* and are curved at both ends of the developer rectifier 9. The developer rectifier 9 is disposed between the back plate 2*a* and the front plate (not shown) and is screwed into the housing 2 through the screw holes 13*a* and 14*a*.

In the lifting guide portion 9*a*, as shown in FIG. 3, an end (inlet) of the curved portion 9*b* keeps a first distance a (upstream control distance in a developer transferring direction) from the developer magnet roller 7 and an end (outlet) of the guide portion 9*c* keeps a second distance b (downstream control distance) from the developer magnet roller 7. Here, the first distance a is greater than the second distance b.

Since the curved portion 9*b* and the guide portion 9*c* are inclined and spaced-apart from the developer magnet roller 7, when a third distance from an arbitrary portion between the curved portion 9*b* and the guide portion 9*c* to the surface of the developer magnet roller 7 is c, the third distance c is greater than the second distance b.

Next, the magnetic flux density 15 over the surface of the magnet roller 7*c* will be described with reference to FIG. 4. Since the developer blade 8 is disposed between S2 and N4, the distribution of the magnetic flux density 15 under the blade tip 8*a* is 5 mT or less. Also, since the developer rectifier 9 is disposed over N3, the magnetic flux density 15 around the developer rectifier 9 is within a range of 15–40 mT.

According to experiments, effects of the developer rectifier 9 were not greatly affected by the magnetic flux density 15 over the developer magnet roller 7 facing the developer rectifier 9. If a region having the magnetic flux density 15 of 10 mT or more exists along an axial direction of the developer magnet roller 7 on the surface of the developer magnet roller 7 opposite to the developer rectifier 9 with respect to the developer magnet roller 7, the developer 16 could be smoothly guided. Thus, in this embodiment, the magnetic flux density 15 is sufficient to make the thickness of the developer 16 on the developer magnet roller 7 uniform.

As long as each component is not limited to particular shape and function, the longitudinal shape and function of each component are determined along an effective development width.

Next, an operation of the two-component developer unit according to the present invention will be described with reference to the drawings. The present invention is characterized in that the developer rectifier 9 is installed and the developer collection guide portion 9*d* is formed around the developer blade 8 so as to improve an image quality. Thus, descriptions of the general operation of the two-component developer unit known to those skilled in the art will be omitted.

Figure 6:
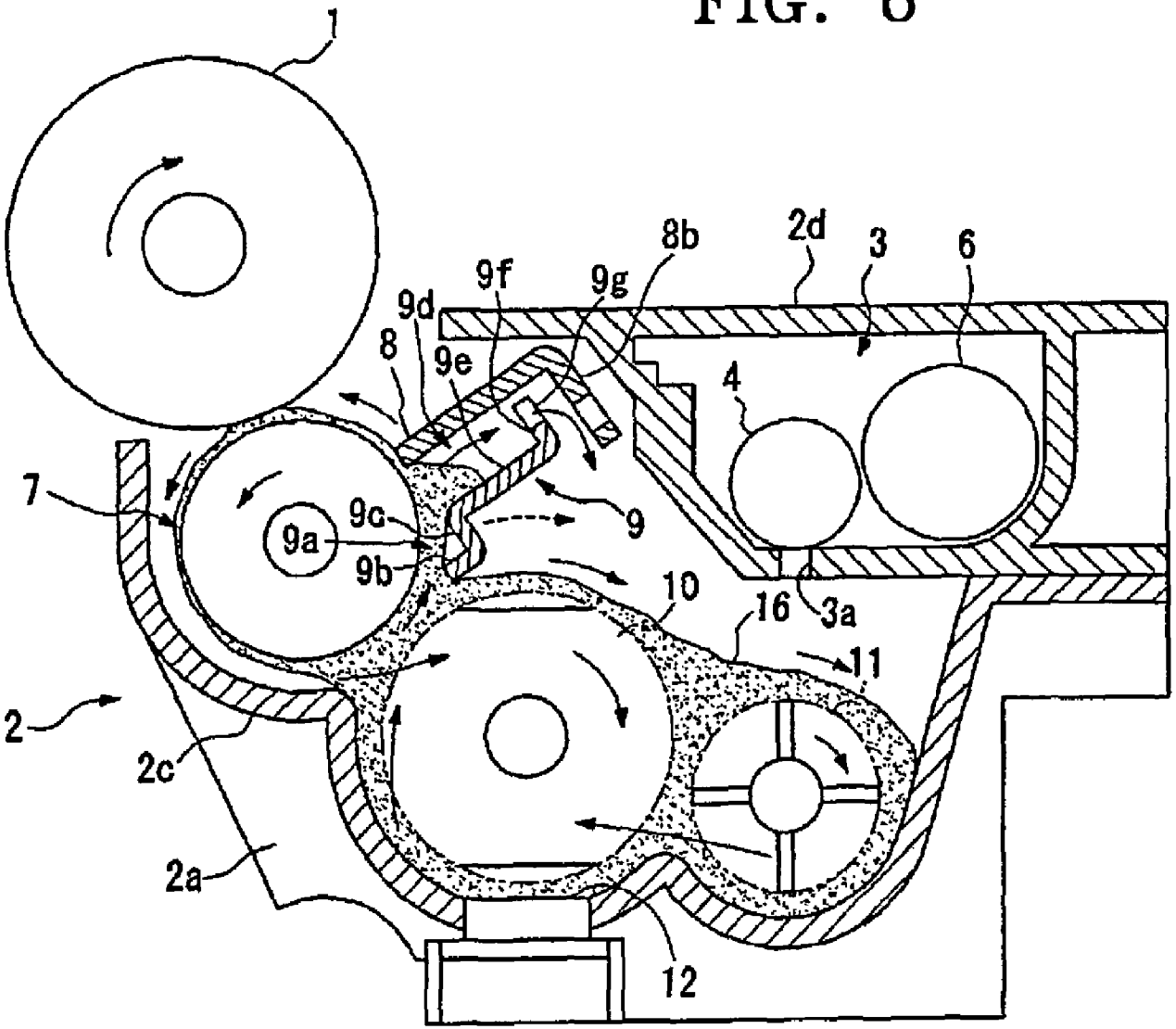
FIG. 6 is a cross-sectional view explaining a flow of a developer in the two-component developer unit shown in FIGS. 3 and 4.

FIG. 6 is a cross-sectional view explaining a flow of the developer 16 in the two-component developer unit shown in FIGS. 3 and 4. Arrows in FIG. 6 denote the flow of the developer 16 except arrows representing rotation directions of rollers.

Referring to FIG. 6, the agitating paddle 11 rotates clockwise, agitates the toner supplied through the toner feeding outlet 3*a* and the developer 16, and sweeps away the toner downward to transfer the toner to the developer transfer roller 10.

The developer transfer roller 10 rotates clockwise to form a passage of toner equal to a passage of toner formed by the agitating paddle 11. Since the developer transfer roller 10 has the transfer paddles 10*a* of FIG. 1 which are obliquely disposed in an axial direction of the developer transfer roller 10, the developer transfer roller 10 lifts up the toner, transfers the toner in the axial direction, and evenly distributes the toner concentrated in the axial direction. Thus, the developer transfer roller 10 forms a more complicated circular path of the toner so as to promote the agitation of toner and evenly distribute the toner on the developer magnet roller 7.

As described above, the developer transfer roller 10 and the agitating paddle 11 constitute an agitating unit.

The lifted developer 16 is transferred to the surface of the developer magnet roller 7 and adheres to the surface of the developer magnet roller 7 by a magnetic force of the developer magnet roller 7. Next, the developer 16 is adsorbed onto the surface of the developer sleeve 7*a*, lifted up, and transferred downward. Here, since inertia, such as gravity and centrifugal force, acts on the developer 16, although the developer 16 is supplied with a magnetic force, a cohesive lump of the developer 16 may fall down or may be scattered to one side of the developer transfer roller 10. In particular, in a case where the developer 16 is distant from the developer sleeve 7*a*, the falling or scattering of the developer 16 becomes more serious.

However, in the above-described lifting unit having a scattering problem, when the lifting guide portion 9*a* of the developer rectifier 9 lifts up the developer 16, the developer 16 may fall or may be scattered downward and laterally.

The developer 16 is guided by the guide portion 9*c* and the curved portion 9*b* and returns to the developer magnet roller 7. Also, since the upstream control distance a is greater than the downstream control distance b, the developer 16 is compressed and rectified in the lifting guide portion 9*a*. Thus, the developer 16 pulsated in the lifting portion 9*c* can be rectified.

The guide portion 9*c* has a gentle inclination at an angle θ of 45° with the surface of the developer magnet roller 7 corresponding to the outlet of the guide portion 9*c*. Thus, the guide portion 9*c* is disposed relatively adjacent along the circumferential direction of the developer magnet roller 7 so as to guide the developer 16 scattered along the diametrical direction of the developer magnet roller 7.

Since the curved portion 9*b* is a curved surface extending from the end of the guide portion 9*c*, the curve portion 9*b* catches the developer 16 obliquely falling down or guided by the guide portion 9*c* and returns the developer 16 to the surface of the developer magnet roller 7. Also, since the curved portion 9*b* is curved along a direction of the developer 16 transferred by the developer transfer roller 10, the inlet of the curved portion 9*b* guides the flow of the developer 16. Thus, the curved portion 9*b* can efficiently and smoothly lift up the developer 16.

Further, besides the above-described operations, the curved portion 9*b* can be designed to secure the upstream control distance a by changing its length along its circumferential direction without modifying its shape even though its layout is somewhat changed.

Several experiments were carried out while changing a diameter and a position of the developer magnet roller 7. When a circumferential width of the lifting guide portion 9*a* is 3 mm or more, the developer 16 is more effectively lifted up than when the circumferential width of the lifting guide portion 9*a* is 3 mm or less.

If the upstream control distance a is greater than or equal to the downstream control distance b, the developer 16 is compressed and rectified to a predetermined thickness. As a result, the ununiformity of image intensity due to the developer 16, which is pulsated when being lifted up, can be solved.

The thickness of the developer 16 on the developer sleeve 7*a* is controlled by the inlet of the curved portion 9*a*, becomes a thickness within the upstream control distance a, and moves downward due to the rotation of the developer sleeve 7*a*. The developer blade 8 re-controls the thickness of the developer 16 within the control distance t. Here, the control distance t is smaller than the upstream control distance a. Thus, since the developer 18 is oversupplied in a region which is not covered with the developer rectifier 9 up the blade tip 8*a*, the developer collection portion is formed in the region.

The remnant of the developer 17 controlled by the developer blade 8 loses its way and proceeds along the developer blade 8. Here, since a region having low magnetic flux density exists around the developer blade 8, the gradient of the developer blade 8 is relatively gentle. Thus, the remnant of the developer 17 immediately falls due to gravity. However, the falling developer 16 is retained along the standing portion 9*e* of the developer collection guide portion 9*d*.

As described above, the developer 16 is collected on the developer collection guide portion 9*d*, overflows through the opening 9*g* of the circumferential portion 9*f*, falls onto the developer transfer roller 10, and re-circulates. Thus, although a pressure in the developer collection portion is increased due to the developer 16, the developer 16 can flow out of the developer collection portion so as to prevent the cohesion of the developer 16.

The developer 16 having a controlled thickness down the developer blade 8 is raised and toner is adhered onto the photoreceptor 1 due to a difference between a developer bias potential and an electrostatic potential. As a result, a latent electrostatic image is developed on the photoreceptor 1. Carrier, which has lost the toner, is adsorbed onto the developer sleeve 7*a*, rotated downward, and returned to the developer transfer roller 10. While the returned carrier is mixed and agitated with new toner, and then circulates, the toner is transferred to the photoreceptor 1, and remaining toner and the carrier are reused in a developing process.

As described above, the developer 16 is guided by the lifting portion 9*c* of the developer rectifier 9 so as to be prevented from being scattered. Since the developer 16 falling over the developer blade 8 can be retained (collected) in the lifting portion 9*c* so as to be prevented from being scattered, although the developer magnet roller 7 is disposed over the developer transfer roller 10, the developer collection portion 9*d* can be formed with the developer blade 8. Thus, since the developer 16 pulsated and transferred to the developer sleeve 7*a* by the developer transfer roller 10 is stripped to a predetermined thickness, the non-uniformity of image intensity can be completely prevented.

Also, as described above, the developer rectifier 9 is a bent plate. However, a material of the developer rectifier 9 is limited to nonmagnetic metals. For example, the developer rectifier 9 may be formed of the synthetic resins by molding. Further, since one side of the developer rectifier 9 guides and retains the developer 16, it is not necessary to form the developer rectifier 9 of a plate having a uniform thickness. If the developer rectifier 9 has identical sides, a backside of the developer rectifier 9 may have any shapes.

Furthermore, the lifting guide portion 9*a* and the developer collection guide portion 9*d* have two flat sides, respectively, to be made into a plate. However, the lifting guide portion 9*a* and the developer collection guide portion 9*d* are not limited to the flat sides. For example, the lifting guide portion 9*a* and the developer collection guide portion 9*d* may have smoothly curved portions between the two sides, respectively, instead of corners.

The lifting guide portion 9*a* may have cylindrical surfaces which keep the control distance a from the developer magnet roller 7 along the axis of the developer magnet roller 7. In this case, a=b=c.

Moreover, the developer rectifier 9 has the curved portion 9*b*. However, the developer rectifier 9 may have only the guide portion 9*c*. In this case, the guide portion 9*c* inclines to maintain the relationship between the upstream control distance a and the downstream control distance b. Thus, the developer 16 falling or scattered from the developer magnet roller 7 is caught by the guide portion 9*c* and returned to the developer magnet roller 7.

Further, the circumferential portion 9*f* of the developer collection guide portion 9*d* has the opening 9*g* so as to overflow an oversupplied developer. However, a length of the circumferential portion 9*f* may be shortened, and a gap between the circumferential portion 9*f* and the developer blade 8 may be formed.

In addition, when the standing portion 9*e* is disposed under the developer blade 8, the standing portion 9*e* operates. Thus, the standing portion 9*e* may be roughly (substantially) parallel to the developer blade 8. In other words, it is not necessary for the standing portion 9*e* to be accurately parallel to the developer blade 8.

As described above, the two-component developer unit of the dry electrophotographic image forming apparatus according to the present invention can achieve the following effects.

First, by placing the developer rectifier, which has a guide side forming a lifting guide portion and a developer collection guide portion between an agitating unit and the developer blade, the developer can be prevented from falling or being scattered downward. Also, the developer collection guide portion can be formed between the developer blade and the developer rectifier.

Second, the lifting guide portion has an inlet and an outlet, and a distance between the inlet and the developer magnet roller is set to an upstream control distance a and a distance between the outlet and the developer magnet roller is set to a downstream control distance b. Here, the upstream control distance a is greater than or equal to the downstream control distance b. Thus, since the developer is compressed and rectified in the lifting guide portion, the non-uniformity of image intensity caused by the developer pulsated when being lifted up can be solved.

Third, the lifting guide portion has a flat guide side to slightly incline to the developer magnet roller. Thus, since the lifting guide portion faces the developer magnet roller along the circumferential direction of the developer magnet roller, the lifting guide portion can efficiently guide the developer scattered from the developer magnet roller to the diametrical direction of the developer magnet roller.

Fourth, since the lifting guide portion can efficiently lift up the developer from the agitating unit along the circumferential direction of the developer magnet roller, the lifting guide portion is highly efficient.

Fifth, since the lifting guide portion can accurately guide the developer, the developer collection guide portion can be formed with the developer blade.

Sixth, the developer can be guided by forming a region having relatively low magnetic flux density, and thus the developer unit, which is not loaded with the developer when designing a magnet roller, can be provided.

Seventh, the lifting guide portion can catch and retain the developer which falls or is scattered over the developer blade. Thus, the developer collection guide portion can be formed on the developer blade.

Eighth, in a case where the developer collection guide portion is filled with the developer, the developer can flow out of the developer collection guide portion. Thus, the developer collection guide portion can be formed without increasing the driving torque.

Although an embodiment of the present invention has been shown and described, it would be appreciated by those skilled in the art that changes may be made in this embodiment without departing from the principles and sprit of the invention, the scope of which is defined in the claims and their equivalents.

What is claimed is:

1. A two-component developer unit comprising:

an agitating unit which agitates a developer having a carrier and toner;

a developer magnet roller which has a magnet roller disposed adjacent to the agitating unit and given a predetermined magnetic flux density and a developer sleeve rotating a circumferential surface of the magnet roller, and which adsorbs the developer thereon by using a magnetic force and returns the developer to the agitating unit;

a developer blade which faces the developer magnet roller and is disposed to be spaced apart from the developer magnet roller by a predetermined control distance along an effective development width of the developer magnet roller and controls a thickness of the developer adhering to the developer magnet roller; and a developer rectifier which guides the developer transferred by the developer magnet roller to the developer blade, which includes a lifting guide portion to guide the developer agitated by the agitated unit so as to transfer the developer toward the developer blade along a circumferential direction of the developer magnet roller, and which includes a developer collection guide portion that retains the developer collected by the lifting guide portion between the developer blade and the developer collection guide portion, the developer rectifier disposed between the agitating unit and the developer blade, the lifting guide portion being substantially L-shaped and comprising a first portion extending along a line which intersects the developer magnet roller and a second portion substantially at a right angle to the first portion, extending along a line which does not intersect the developer magnet roller, and downstream relative to the first portion in a guiding direction of the developer.

2. The two-component developer unit of claim 1, wherein the lifting guide portion further comprises:

an inlet at the portion spaced apart from a surface of the developer magnet roller by an upstream control distance; and an outlet at the second portion spaced apart from a surface of the developer magnet roller by a downstream control distance, wherein the upstream control distance is greater than or equal to the downstream control distance.

3. A two-component developer unit comprising:

an agitating unit which agitates a developer having a carrier and toner;

a developer magnet roller which has a magnet roller disposed adjacent to the agitating unit and given a predetermined magnetic flux density and a developer sleeve rotating a circumferential surface of the magnet roller, and which adsorbs the developer thereon by using a magnetic force and returns the developer to the agitating unit;

a developer blade which faces the developer magnet roller and is disposed to be spaced apart from the developer magnet roller by a predetermined control distance along an effective development width of the developer magnet roller and controls a thickness of the developer adhering to the developer magnet roller; and a developer rectifier which guides the developer transferred by the developer magnet roller to the developer blade, which includes a lifting guide portion that guides the developer agitated by the agitating unit so as to transfer the developer toward the developer blade along a circumferential direction of the developer magnet roller, and which includes a developer collection guide portion that retains the developer collected by the lifting guide portion between the developer blade and the developer collection guide portion, the developer rectifier disposed between the agitating unit and the developer blade, wherein the lifting guide portion comprises a guide width formed between the inlet of the lifting guide portion and the outlet of the lifting guide portion, and the guide width is 3 mm or more.

4. A two-component developer unit comprising:

an agitating unit which agitates a developer having a carrier and toner;

a developer magnet roller which has a magnet roller disposed adjacent to the agitating unit and given a predetermined magnetic flux density and a developer sleeve rotating a circumferential surface of the magnet roller, and which adsorbs the developer thereon by using a magnetic force and returns the developer to the agitating unit;

a developer blade which faces the developer magnet roller and is disposed to be spaced apart from the developer magnet roller by a predetermined control distance along an effective development width of the developer magnet roller and controls a thickness of the developer adhering to the developer magnet roller; and a developer rectifier which guides the developer transferred by the developer magnet roller to the developer blade, which includes a lifting guide portion that guides the developer agitated by the agitating unit so as to transfer the developer toward the developer blade along a circumferential direction of the developer magnet roller, and which includes a developer collection guide portion that retains the developer collected by the lifting guide portion between the developer blade and the developer collection guide portion, the developer rectifier disposed between the agitating unit and the developer blade, wherein the lifting guide portion comprises:

an inlet spaced apart from a surface of the developer magnet roller by an upstream control distance, an outlet spaced apart from a surface of the developer magnet roller by a downstream control distance, wherein the upstream control distance is greater than or equal to the downstream control distance, and a guide portion which has a flat side is inclined at an angle of 45° or less with the surface of the developer magnet roller so as to guide the developer to the developer blade.

5. The two-component developer unit of claim 4, wherein the guide portion comprises:

a curved portion which extends from one end of the guide portion and curves to the developer magnet roller.

6. A two-component developer unit comprising:

an agitating unit which agitates a developer having a carrier and toner;

a developer magnet roller which has a magnet roller disposed adjacent to the agitating unit and given a predetermined magnetic flux density and a developer sleeve rotating a circumferential surface of the magnet roller, and which adsorbs the developer thereon by using a magnetic force and returns the developer to the agitating unit;

a developer blade which faces the developer magnet roller and is disposed to be spaced apart from the developer magnet roller by a predetermined control distance along an effective development width of the developer magnet roller and controls a thickness of the developer adhering to the developer magnet roller; and a developer rectifier which guides the developer transferred by the developer magnet roller to the developer blade, which includes a lifting guide portion that guides the developer agitated by the agitating unit so as to transfer the developer toward the developer blade along the circumferential direction of the developer magnet roller, and which includes a developer collection guide portion that retains the developer collected by the lifting guide portion between the developer blade and the developer collection guide portion, the developer rectifier disposed between the agitating unit and the developer blade, wherein the lifting guide portion comprises:

a guide portion which has a flat side inclined at an angle of 45° or less with a surface of the developer magnet roller so as to guide the developer to the developer blade.

7. The two-component developer unit of claim 6, wherein the guide portion comprises:

a curved portion which extends from one end of the guide portion and curves to the developer magnet roller.

8. A two-component developer unit comprising:

an agitating unit which agitates a developer having a carrier and toner;

a developer magnet roller which has a magnet roller disposed adjacent to the agitating unit and given a predetermined magnetic flux density and a developer sleeve rotating a circumferential surface of the magnet roller, and which adsorbs the developer thereon by using a magnetic force and returns the developer to the agitating unit;

a developer blade which faces the developer magnet roller and is disposed to be spaced apart from the developer magnet roller by a predetermined control distance along an effective development width of the developer magnet roller and controls a thickness of the developer adhering to the developer magnet roller; and a developer rectifier which guides the developer transferred by the developer magnet roller to the developer blade, which includes a lifting guide portion that guides the developer agitated by the agitating unit so as to transfer the developer toward the developer blade along a circumferential direction of the developer magnet roller, and which includes a developer collection guide portion that retains the developer collected by the lifting guide portion between the developer blade and the developer collection guide portion, the developer rectifier disposed between the agitating unit and the developer blade, wherein the developer sleeve comprises:

a region formed along an axial direction of the developer sleeve, facing the lifting guide portion, and having a magnetic flux density of 10 mT.

9. A two-component developer unit comprising:

an agitating unit which agitates a developer having a carrier and toner;

a developer magnet roller which has a magnet roller disposed adjacent to the agitating unit and given a predetermined magnetic flux density and a developer sleeve rotating a circumferential surface of the magnet roller, and which adsorbs the developer thereon by using a magnetic force and returns the developer to the agitating unit;

a developer blade which faces the developer magnet roller and is disposed to be spaced apart from the developer magnet roller by a predetermined control distance along an effective development width of the developer magnet roller and controls a thickness of the developer adhering to the developer magnet roller; and a developer rectifier which guides the developer transferred by the developer magnet roller to the developer blade, which includes a lifting guide portion that guides the developer agitated by the agitating unit so as to transfer the developer toward the developer blade along a circumferential direction of the developer magnet roller, and which includes a developer collection guide portion that retains the developer collected by the lifting guide portion between the developer blade and the developer collection guide portion, the developer rectifier disposed between the agitating unit and the developer blade, wherein the developer collection guide portion comprises:

a standing portion which extends from an end of the lifting guide portion to a direction away from the developer magnet roller and is substantially parallel to the developer blade; and a circumferential portion which extends from an end of the standing portion in a circumferential direction of the developer magnet roller.

10. The two-component developer unit of claim 9, wherein the circumferential portion comprises:

an opening through which the developer passes.

11. A developer unit comprising:

a developer magnet roller having a magnet roller and a developer sleeve rotating around the magnet roller, adsorbing a developer contained in the developer unit thereon by using a magnetic force, and having an upstream and a downstream in a direction of transferring the developer along the developer magnet roller;

a developer blade disposed on the downstream and having an end disposed to be spaced apart from the developer magnet roller by a control distance along an effective development width of the developer magnet roller to control a thickness of the developer adhering to the developer magnet roller; and a developer rectifier disposed on the upstream to guide the developer transferred by the developer magnet roller to the developer blade along circumferential direction of the developer magnet roller, and having an end disposed to be spaced-apart from the developer roller by a stream distance being greater than the control distance.

the developer rectifier comprising a lifting guide portion being substantially L-shaped and comprising a first portion extending along a line which intersects the developer magnet roller and a second portion substantially at a right angle to the first portion, extending along a line which does not intersect the developer magnet roller, and in the downstream direction relative to the first portion.

12. The developing unit of claim 11, wherein developer magnet roller comprises:

magnets disposed in an inside of the magnet roller, having different polarities, forming a magnetic flux density around the developer sleeve.

13. The developing unit of claim 12, wherein the magnetic flux density is in a range between 40 mT and 85 mT inclusive.

14. The developing unit of claim 12, wherein the developer rectifier is disposed in the magnetic flux density of a range between 15 mT and 40 mT inclusive.

15. The developing unit of claim 12, wherein the magnets comprise first polarity magnets and second polarity magnets, and the developer blade is disposed on a position between the first polarity magnet and the second polarity magnet while the developer rectifier is disposed on another position corresponding to one of the first polarity magnets and the second polarity magnets.

16. The developing unit of claim 15, wherein the one of the first polarity magnets and the second polarity magnets is a N-polarity magnet.

17. A developer unit comprising:

a developer magnet roller having a magnet roller and a developer sleeve rotating around the magnet roller, adsorbing a developer contained in the developer unit thereon by using a magnetic force, and having an upstream and a downstream in a direction of transferring the developer along the developer magnet roller;

a developer blade disposed on the downstream and having an end disposed to be spaced apart from the developer magnet roller by a control distance along an effective development width of the developer magnet roller to control a thickness of the developer adhering to the developer magnet roller; and a developer rectifier disposed on the upstream to guide the developer transferred by the developer magnet roller to the developer blade, and having an end disposed to be spaced-apart from the developer roller by a stream distance being greater than the control distance, wherein the developer magnet roller comprises magnets disposed in an inside of the magnet roller, having different polarities, forming a magnetic flux density around the developer sleeve, a region having the magnet flux density of 10 mT or more and another region opposite to the region with respect to a center of the developer magnet roller, and the developer rectifier is disposed on a portion corresponding to another region of the developer magnet roller.

18. The developing unit of claim 11, wherein the developing unit comprises an agitating unit forming the developer, and the developer rectifier is disposed between the developer blade and the agitating unit.

19. A developer unit comprising:

a developer magnet roller having a magnet roller and a developer sleeve rotating around the magnet roller, adsorbing a developer contained in the developer unit thereon by using a magnetic force, and having an upstream and a downstream in a direction of transferring the developer along the developer magnet roller;

a developer blade disposed on the downstream and having an end disposed to be spaced apart from the developer magnet roller by a control distance along an effective development width of the developer magnet roller to control a thickness of the developer adhering to the developer magnet roller; and a developer rectifier disposed on the upstream to guide the developer transferred by the developer magnet roller to the developer blade, and having an end disposed to be spaced-apart from the developer roller by a stream distance being greater than the control distance, wherein the developer rectifier comprises:

a non-magnetic plate.

20. A developer unit comprising:

a developer magnet roller having a magnet roller and a developer sleeve rotating around the magnet roller, adsorbing a developer contained in the developer unit thereon by using a magnetic force, and having an upstream and a downstream in a direction of transferring the developer along the developer magnet roller;

a developer blade disposed on the downstream and having an end disposed to be spaced apart from the developer magnet roller by a control distance along an effective development width of the developer magnet roller to control a thickness of the developer adhering to the developer magnet roller; and a developer rectifier disposed on the upstream to guide the developer transferred by the developer magnet roller to the developer blade, and having an end disposed to be spaced-apart from the developer roller by a stream distance being greater than the control distance, wherein the developer rectifier comprises:

one of brass, stainless steel, and an aluminum alloy.

21. A developer unit comprising:

a developer magnet roller comprising a plurality of magnets rotating in a rotating direction, and having an upstream and a downstream along the rotating direction;

developer blade disposed on the downstream of the developer magnet roller and having an end disposed to be spaced apart from the developer magnet roller by a control distance along an effective development width of the developer magnet roller; and a developer rectifier disposed on the upstream of the developer magnet roller directly opposite to one of the magnets and having an end disposed to be spaced-apart from the developer roller by a stream distance being greater than the control distance, the developer rectifier comprising a lifting guide portion, being substantially L-shaped and comprising a first portion extending along a line which intersects the developer magnet roller and a second portion substantially at a right angle to the first portion, extending along a line which does not intersect the developer magnet roller, and on the downstream relative to the first portion.

22. A developer unit comprising:

a developer magnet roller having a magnet roller and a developer sleeve rotating around the magnet roller, adsorbing a developer contained in the developer unit thereon by using a magnetic force, and having an upstream and a downstream in a direction of transferring the developer along the developer magnet roller;

a developer blade disposed on the downstream and having an end disposed to be spaced apart from the developer magnet roller by a control distance along an effective development width of the developer magnet roller to control a thickness of the developer adhering to the developer magnet roller; and a developer rectifier disposed on the upstream to guide the developer transferred by the developer magnet roller to the developer blade, and having an end disposed to be spaced-apart from the developer roller by a stream distance being greater than the control distance, wherein the developer rectifier comprises:

a nonmagnetic plate made of brass, stainless steel, or an aluminum alloy.

23. The developer unit of claim 11, wherein the developer rectifier comprises:

a W-shaped surface having a V shaped curve.

24. The developer unit of claim 11, wherein the developer rectifier comprises:

a first portion spaced-apart from the developer roller by the stream distance; and a second portion extended from the first portion away from the developer magnet roller.

25. A developer unit comprising:

a developer magnet roller having a magnet roller and a developer sleeve rotating around the magnet roller, adsorbing a developer contained in the developer unit thereon by using a magnetic force, and having an upstream and a downstream in a direction of transferring the developer along the developer magnet roller;

a developer blade disposed on the downstream and having an end disposed to be spaced apart from the developer magnet roller by a control distance along an effective development width of the developer magnet roller to control a thickness of the developer adhering to the developer magnet roller; and a developer rectifier disposed on the upstream to guide the developer transferred by the developer magnet roller to the developer blade, and having an end disposed to be spaced-apart from the developer roller, wherein the developer rectifier comprises:

a first portion spaced-apart from the developer roller, and a second portion extended from the first portion away from the developer magnet roller, and wherein the first portion comprises:

a curved portion having a first distance with the developer magnet roller; and a guide portion in the downstream direction relative to the curved portion, having an angle with the curved portion and having a second distance with the developer magnet roller, the first distance being greater than the second distance, and the first distance and the second distance both being greater than the control distance.

26. The developer unit of claim 25, wherein the curved portion and the guide portion each form an angle with a tangential surface of the developer magnet roller.

27. The developer unit of claim 26, wherein the angle is in a range between 0° and 45° inclusive.

28. The developer unit of claim 25, wherein the second portion comprises:

a standing portion extended from an end of the guide portion opposite to the curved portion in a direction having an angle with a radial direction of the developer magnet roller.

29. The developer unit of claim 28, wherein the angle is in a range between 0 and 45° inclusive.

30. The developer unit of claim 28, wherein the standing portion is substantially parallel to the developer blade.

31. The developer unit of claim 28, wherein the second portion comprises:

a circumferential portion extending from the standing portion toward the developer blade to face a surface of the developer magnet roller.

32. The developer unit of claim 31, wherein the developer unit comprises a developer, and the developer rectifier guides the developer from the upstream toward the downstream and the developer blade.

33. The developer unit of claim 32, wherein the curved portion and the guide portion form a lifting guide portion transferring the developer toward the developer blade, and the standing portion and the circumferential portion form a developer collection guide portion to retain the developer between the developer blade and the standing portion.

34. The developer unit of claim 31, wherein the circumferential portion comprises:

an opening to allow the lifting guide portion and the developer collection guide portion to communicate with each other to overflow an oversupplied developer.

* * * * *

UNITED STATES PATENT AND TRADEMARK OFFICE

CERTIFICATE OF CORRECTION

PATENT NO. : 7,050,745 B2
APPLICATION NO. : 10/256236
DATED : May 23, 2006
INVENTOR(S) : Susumu Kikuchi It is certified that error appears in the above-identified patent and that said Letters Patent is hereby corrected as shown below:

Column 11, Line 21 after "by the" change "agitated" to --agitating--.

Column 11, Line 39 after "at the" insert --first--.

Column 14, Line 45 after "along" insert --a--.

Column 14, Line 49 after "distance" change "." to --,--.

Column 16, Line 23 insert --a-- before "developer blade".

Column 18, Line 10 change "0" to --0°--.

Signed and Sealed this

Twenty-eighth Day of November, 2006

JON W. DUDAS
*Director of the United States Patent and Trademark Office*